US011744311B2

(12) United States Patent
Drasler

(10) Patent No.: US 11,744,311 B2
(45) Date of Patent: Sep. 5, 2023

(54) INFLATABLE HEAD COVERING

(71) Applicant: William Joseph Drasler, Minnetonka, MN (US)

(72) Inventor: William Joseph Drasler, Minnetonka, MN (US)

( * ) Notice: Subject to any disclaimer, the term of this patent is extended or adjusted under 35 U.S.C. 154(b) by 178 days.

(21) Appl. No.: 17/348,856

(22) Filed: Jun. 16, 2021

(65) Prior Publication Data

US 2022/0015490 A1 Jan. 20, 2022

Related U.S. Application Data

(60) Provisional application No. 63/053,610, filed on Jul. 18, 2020.

(51) Int. Cl.

| | |
|---|---|
| ***A42B 3/04*** | (2006.01) |
| ***A42B 3/32*** | (2006.01) |
| ***A42B 1/203*** | (2021.01) |
| ***A42B 3/12*** | (2006.01) |
| ***A42B 3/06*** | (2006.01) |

(52) U.S. Cl.

CPC ..... *A42B 3/122* (2013.01); *A42B 3/069* (2013.01); *A42B 3/322* (2013.01)

(58) Field of Classification Search

CPC ..... A42B 3/122; A42B 3/069; A42B 3/227; A42B 3/322; A42B 1/203

See application file for complete search history.

(56) References Cited

U.S. PATENT DOCUMENTS

| | | | | |
|---|---|---|---|---|
| 6,178,560 | B1 * | 1/2001 | Halstead | A42B 3/122 2/413 |
| 2016/0058094 | A1 * | 3/2016 | Vance | A42B 3/122 2/413 |
| 2017/0189786 | A1 * | 7/2017 | Riggs | A42B 3/122 |
| 2019/0125025 | A1 * | 5/2019 | Williams | A42B 3/066 |

FOREIGN PATENT DOCUMENTS

| | | | | |
|---|---|---|---|---|
| CA | 2090347 | C * | 11/1997 | A42B 3/066 |
| CN | 104161332 | A * | 11/2014 | A42B 3/322 |
| ES | 1077831 | U * | 10/2012 | A42B 3/322 |
| ES | 1226795 | U * | 3/2019 | |
| KR | 100973975 | B1 * | 8/2010 | A42B 3/122 |

* cited by examiner

*Primary Examiner* — Daniel J Colilla

(57) ABSTRACT

A head covering to reduce the force from an external surface on the head of an individual. The head covering is formed from thin polymeric tubes that are inflated by blowing via lung exhalation. The head covering is light weight and can be folded into a small in volume such that it is easily carried in a shirt or pant pocket.

19 Claims, 8 Drawing Sheets

FIG. 5A
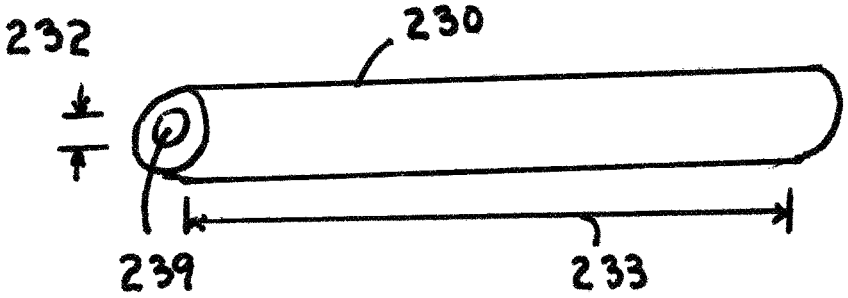
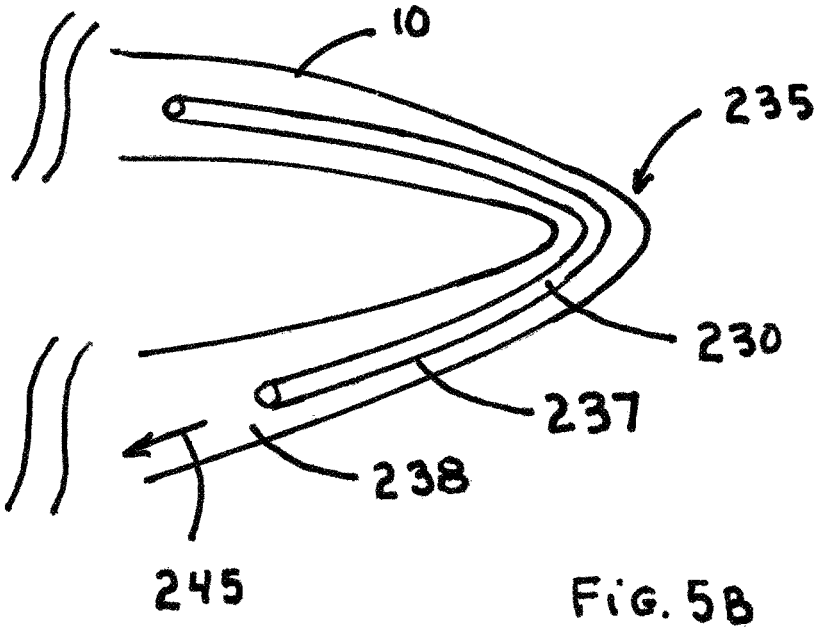
FIG. 5B

INFLATABLE HEAD COVERING

CROSS REFERENCE TO RELATED APPLICATIONS

This patent application makes reference to and thereby incorporates all information found in the provisional patent applications numbered: 63/053,610 entitled Inflatable Head Covering filed 18 Jul. 2020 by William J. Drasler.

BACKGROUND

Individuals can be faced with a situation in which they would like to have a head covering that provides a partial barrier to reduce the force of an external environmental surface onto the head of an individual and the outside environment. Several current head coverings are bulky and heavy and not easily carried on one's body; such head coverings are often not available when needed by the individual. What is needed is a low-weight, non-bulky head covering that can be easily carried in the individuals pocket, inflated easily by the individual without use of an outside inflation mechanism, and applied to the head to provide a partial barrier to reduce the force to the head of an individual from contact from an environmental surface.

SUMMARY

The present invention is a head covering formed from one or more inflatable tubes that extend around the front, back, and both sides of the head covering; one or more of the inflatable tubes can also extend along the top of the head covering. More than one inflatable tube or more than one portion of a single inflatable tube can be located on each side of the head covering as desired. The inflatable tubes are generally cylindrically shaped with a curvature that matches the curvature of a head of an individual. The inflatable tubes are separated by a tube spacing that allows air flow from the environment to have direct access to the head of the individual to allow the head to remain cool and comfortable on a hot day. The inflatable tubes are inflated at a pressure that is generated by the individual blowing into an inflation port as the individual expels air from his lungs during exhalation without the need for an external mechanical inflation device. The head covering is light weight and can be deflated and folded and stored easily in a shirt or pant pocket or in a small bag with a volume of about 15 cubic inches, for example. The head covering is applied to the head of the individual to provide a barrier for the head to the environment to reduce the force of an environmental surface in contact with the head covering from transferring to the head of the individual. The size of the head covering or head covering diameter can be adjusted to match the head size of the individual by adjusting the inflation pressure provided by the individual to the interior lumens of the inflatable tubes. The present head covering can be manufactured at a low cost allowing the head covering to be a disposable device that is used as few as once prior to disposal or as many as 100 times or more prior to disposal, for example.

BRIEF DESCRIPTION OF THE DRAWINGS

FIG. 5A is an anti-kink tube that can be place within a lumen of an inflatable tube to prevent kinking of the inflatable tube in a tight bend.

FIG. 5B shows the anti-kink tube placed within a lumen of a section of an inflatable tube at a tight bend.

DETAILED DESCRIPTION

Figure 1A:
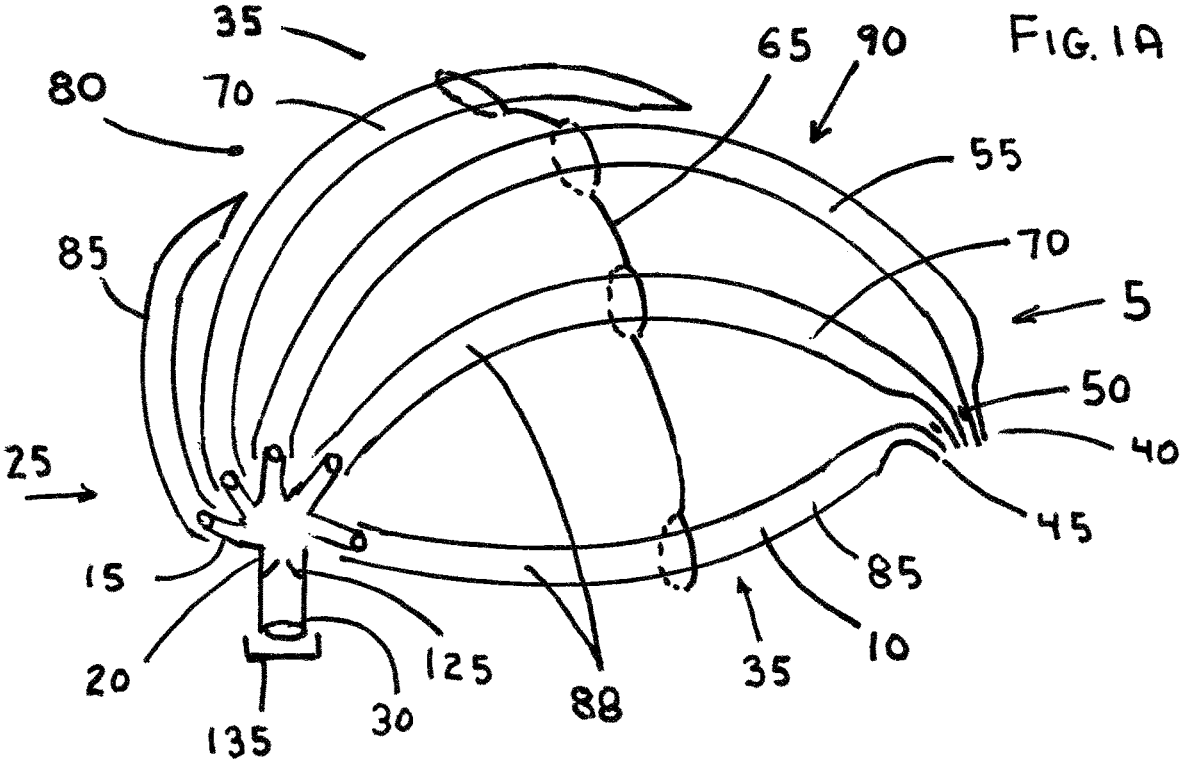
FIG. 1A is a perspective view of the head covering in an inflated configuration.
Figure 1B:
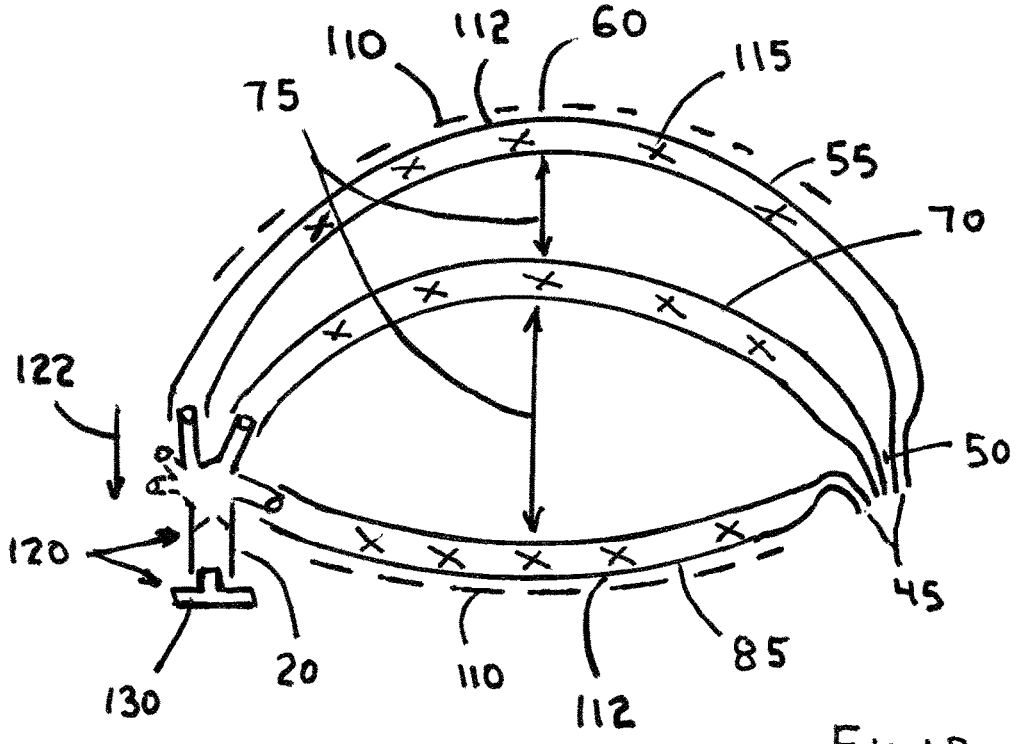
FIG. 1B is a side view of the head covering having braided inflatable tubes.
Figure 1C:
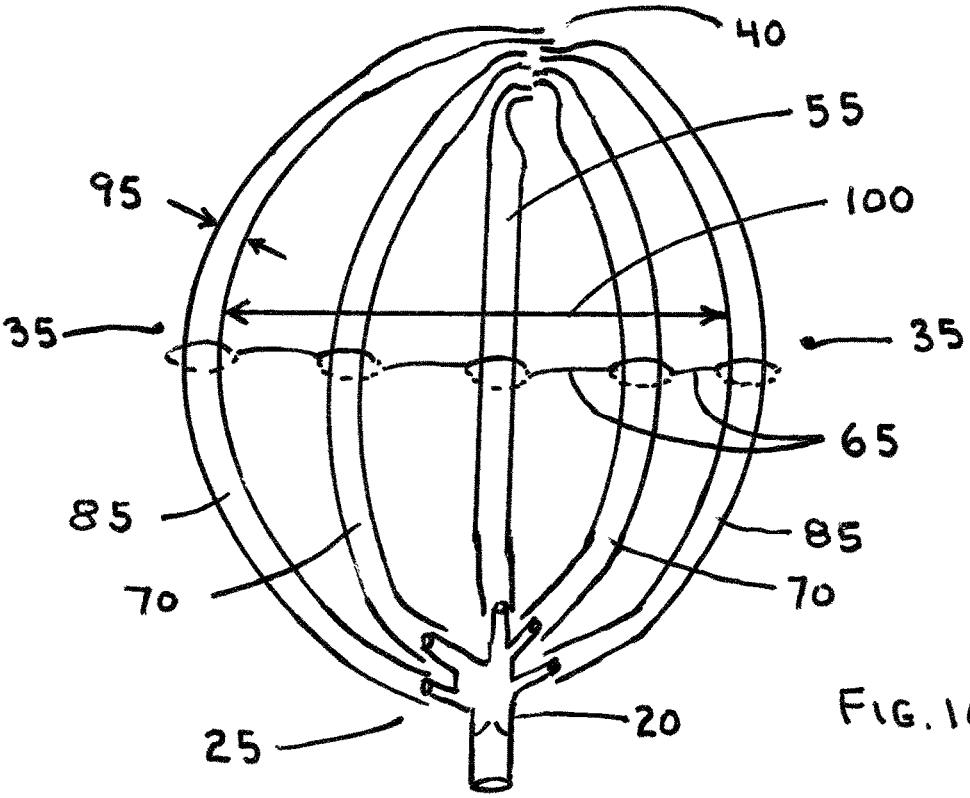
FIG. 1C is a top view of the head covering with a head covering diameter.
Figure 1D:
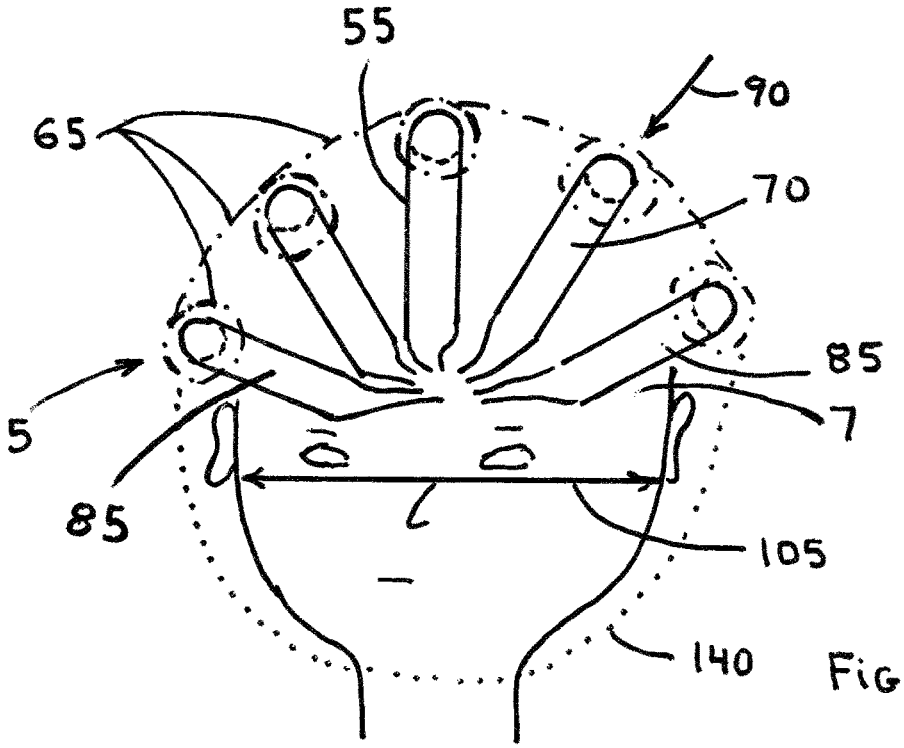
FIG. 1D is a frontal view of the head covering on the head of an individual.

The head covering of the present invention has one or more inflatable tubes that extend around the front 40, back 25, and each side 35 of the head covering as shown in FIGS. 1A-1D. The head covering 5 can also have a top inflatable tube 55 to reduce direct contact from an environmental surface to the top of the head 7 of an individual. The sides 35 of the head covering 5 can have separate lateral inflatable tubes 80 located on the left side and on the right side of the head covering 5. Alternately, each side 35 of the head covering 5 can have both a separate middle-side inflatable tube 70 and a separate lateral inflatable tube 85 located on each side 35 of the head covering; i.e., the left side of the head covering 5 can have, for example, a separate lateral inflatable tube 85 and a separate middle-side inflatable tube 70 as shown in FIGS. 1A-1D.

FIGS. 1A, 1B, 1C, and 1D show an embodiment of the head covering 5 of the present invention having a perspective, side view, top view, and frontal view, respectively, of the head covering 5 to be placed over the top of a head 7 of an individual. Five (range 1-15) separate inflatable tubes 10, for example, are attached to five nipples 15, for example, of a manifold at the back 25, for example, of the head covering 5. The manifold directs air flow from an inflation port 30 to one or more inflatable tubes 10. The inflatable tubes 10 extend along a curved arc from the back 25 of the head covering 5, along the side 35, and to the front 40 of the head covering 5 where the inflatable tubes 10 can form an end closure 45 such as a flattened tube or sealed tube, for example, that creates a dead end for an inflatable tube 10. Each end closure 45 can be permanently attached to another end closure 45, for example, at the front 40 of the head covering 5 forming a tube attachment 50 that attaches or bonds one inflatable tube to another inflatable tube or attaches the inflatable tube to another member or element of the head covering 5 to hold the inflatable tube in place and prevent relative movement of the inflatable tubes 10.

As shown in FIGS. 1A-1D, the top inflatable tube 55 extends along the top 60 of the head covering 5 and is connected via tube connectors 65 to right and left middle-side inflatable tubes 70 located on the right and left side 35 of the head covering 5; the tube connectors 65 are positioned at one or more locations between the front 40 and the back 25 of the head covering 5 to ensure that tube spacing 75 of one inflatable tube 10 is spaced a specified distance from another neighboring inflatable tube 10 of about 2 cm (range 1-8 cm). The top inflatable tube 55 is provided with a tube spacing 75 from each middle-side inflatable tube 70 along the head covering side 35, for example; too close of a tube spacing 75 will not provide good air flow from the external environment 80 located around the outside of the head covering 5 to the head 7 of the individual; too far of a tube spacing 75 will not provide a barrier from the external environment 80 as desired by the individual to help reduce the transfer of an environmental force 90 from an environmental surface found within the external environment 80 to the individual's head 7; such environmental force can occur between the individual's head 7 and the ground, a moving object, or other stationary object or other environmental surface. Similarly, right and left middle-side inflatable tubes 70 are connected via tube connectors 65 to neighboring right and left lateral inflatable tubes 85 along the right and left sides 35 of the head covering 5, respectively, to provide a tube spacing 75 between two neighboring inflatable tubes 88. The tube spacing 75 provides direct contact of air from the external environment 80 to the head 7 of the individual; such direct air contact provides comfort from potential of overheating of the head 7 that could occur without such direct air contact. The middle-side inflatable tubes 70 are located approximately intermediate between the top inflatable tube 55 and the lateral inflatable tubes 85. The tube connector can be formed from a fiber or cloth strap, for example, that is attached to the top inflatable tube 55, middle-side inflatable tube 70, and lateral inflatable tubes 85 at locations intermediate between the front 40 and the back 25 of the head covering 5.

The inflatable tubes 10 can be formed from a polymer tube formed from polymer such as polyethylene terephthalate (PET), polyethylene, polypropylene, polyurethane, Nylon, silicone, or other polymer that can be formed into a tubular shape. The polymer tube can be formed by an extrusion, for example, followed by an expansion step such as a thermal heating and pneumatic expanding process or other process that enlarges the diameter of the polymer tube while thinning the wall thickness and adding both axial and radial strength; the polymer tube can also undergo axial stretching while it is undergoing diametric stretch to provide the axial strength to the inflatable tube 10. The inflatable tubes 10 can alternately be formed from thermal welding of two plastic films into a tubular shape. The inflatable tubes 10 can have a tubing diameter 95 of 0.75 inch (range 0.30-1.5 inches) and a wall thickness of 0.003 inches (range 0.001-0.008 inches). The inflatable tube 10 can be easily folded into a flat or compact shape that allows the head covering 5 to be easily transported in an uninflated configuration in a standard shirt or pant pocket; the uninflated volume of the head covering is about 15 cubic inches.

The inflatable tube 10 that is formed from PET or other noncompliant polymer, for example, may undergo minimal creep due to the inflation pressure after it has been inflated directly by the individual (i.e., less than 5% diameter creep) and can provide a desirable barrier that is more resistant to compressive external environmental forces 90 that would tend to stretch or flatten the inflatable tube 10 formed with an elastomeric polymer such as polyurethane, for example, with the inflatable tube 10 in an inflated configuration. Flattening of an inflatable tube 10 in its inflated configuration could undesirably allow a compressive external environmental force 90 to transfer from an external environmental surface through the inflatable tube 10 to the head 7 of the individual. The inflatable tube 10 can be formed from an elastic material such as polyurethane, silicone, and others to provide an enlargement of the inflatable tubing diameter 95 with increased inflation pressure and hence provide a greater distance between the individual's head 7 and the outside environment via a larger tubing diameter 95. Also, increased inflation pressure can also increase the head covering diameter 100 in order to provide a more loose or more desired fit of the head covering 5 to the head diameter 105 of an individual's head 7. It is noted that placing a restraining member 110 such as a non-extendable fiber or fabric along the outside surface 112 of the inflatable tube 10 will cause the head covering diameter 100 to attain a smaller head covering diameter 100 when inflated to a larger pressure thereby providing for an adjustable fit of the head covering diameter 100 to a head diameter 105 of an individual.

Alternately, for inflatable tubes 10 that are able to expand in length axially under increased pressure (without significant diametric enlargement, i.e., less than 10%, for example) such as inflatable tubes 10 formed from some noncompliant polymers (that are processed to provide axial extension upon inflation), for example, the head covering diameter 100 could increase with increased inflation pressure. The head covering diameter 100 can thus be adjusted to fit or match the head diameter 105 or size of the individual's head 7 by adjusting the inflation pressure being provided to the inflatable tubes 10 by the individual's expiration pressure as air is blown into the inflation port 30 through expiration of air from the individual.

Each inflatable tube 10 can be formed as a braided inflatable tube 115 that has two or more helically oriented intertwined polymeric fibers, for example, located within the wall of the braided inflatable tube 115 or are attached to the outer surface 112 around the circumference of the wall of the inflatable tube 10. The braided inflatable tube 115 will confer a greater amount of resistance to abrasion due to contact with an outside environmental surface and may provide greater durability to the braided inflatable tube 115 in comparison to an inflatable tube 10 that is not braided. Also, as the braided inflatable tube 115 is inflated to a larger pressure, the tubing diameter 95 of the braided inflatable tube 115 will increase, but the length of the inflatable tube 10 will decrease and provide a smaller head covering diameter 100 that can be adjusted to fit the individual's head diameter 105 by adjusting the inflation pressure.

Each inflatable tube 10 can be bonded via thermal bond, adhesive bond, or other form of bond or weld to a nipple 15 located on the manifold located at the back 25 of the head covering 5, for example. The manifold 20 can be formed from a plastic that is molded, for example, with one or more nipples 15 or the manifold 20 can be a thermally formed portion of an inflatable tube 10 that forms an inflation port 30 of the inflatable tube 10. Each nipple 15 can be bonded to each of the inflatable tubes 10 using adhesive, thermal bonding, or solvent bonding, for example. The manifold has an inflation port 30 that is attached and in fluid communication with the manifold that is used by the individual to blow into the inflatable port to inflate the inflatable tubes 10 via a lung expiration pressure of about 35 cm H2O (range 20-90 cm H2O), and also the inflation port 30 is used for deflation of the inflatable tubes 10. An inflation port blocker 120 (located upstream 122 of the inflatable tubes 10) such as a valve 125 located in the manifold, an inflation plug 130 in the inflation port 30, or an inflation cap 135 over the inflation port 30, for example, prevents air from leaking out of the inflation port 30 and inflatable tubes 10 during use of the head covering 5. Upon applying a compressive force by the individual to the valve 125 allows leaflets of a duckbill valve version of valve 125, for example, to open and allow deflation of the inflatable tubes 10 when head covering 5 use is complete and the head covering 5 is ready to be deflated for storage or for transport. The head covering 5 can then be folded into a small flat packet that can be easily carried in a standard shirt or pant pocket for transport following deflation of the head covering 5.

The head covering 5 of the present invention can have a chin strap 140 extending from the lateral inflatable tube 85 on one side 35 of the head covering 5 to the lateral inflatable tube 85 on the other side of the head covering 5, for example. Such a chin strap 140 can provide an improved securement of the head covering 5 to the head 7 of the individual.

Figure 2A:
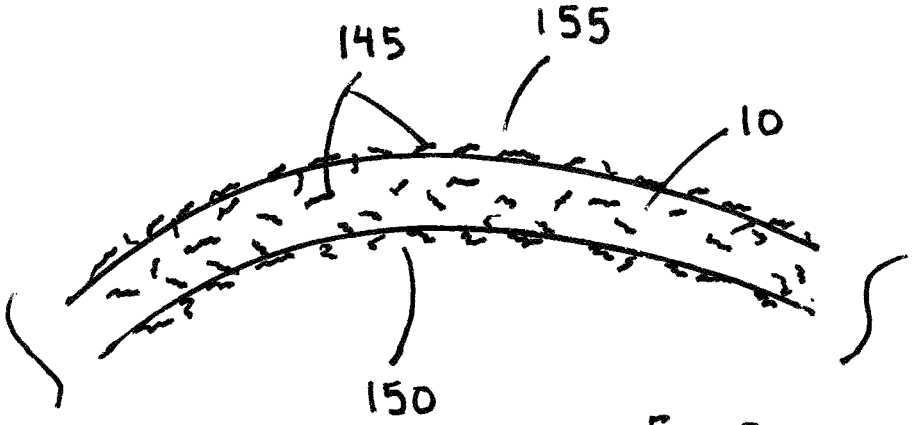
FIG. 2A is a plan view of a portion of an inflatable tube having a velour material attached along its entire surface.
Figure 2B:
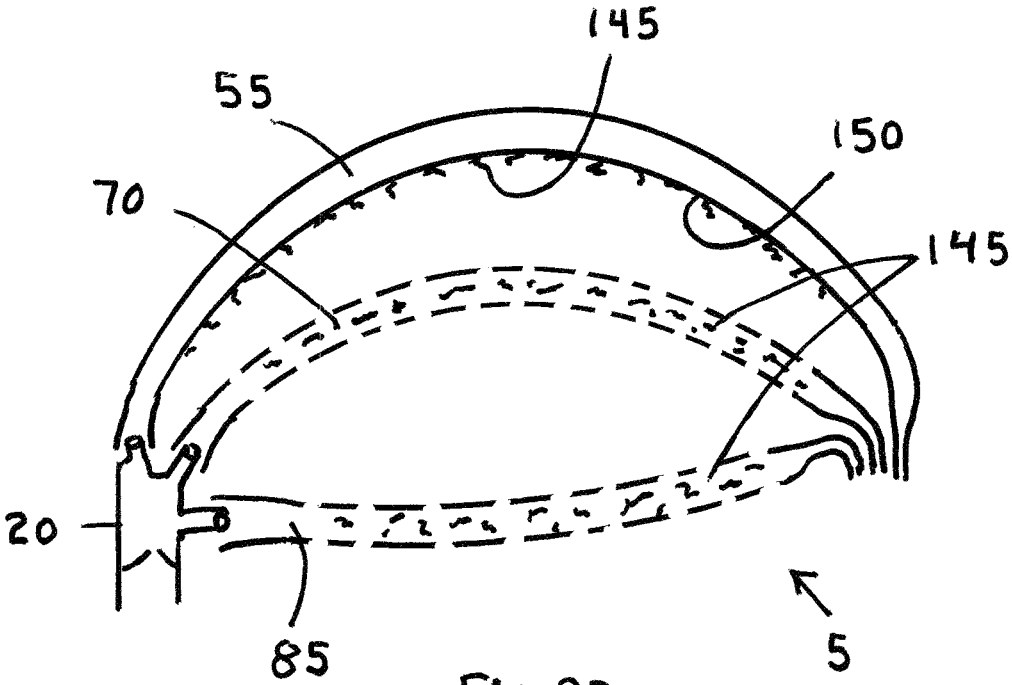
FIG. 2B is a cut-away view of the head covering showing the contact surface in contact with the head of an individual with velour material attached only on the contact surface.

Each tube can be coated with a velour material 145 or fibrous covering that provides a more comfortable feel against the individual's skin or head 7. Such a velour material 145 can be formed from Dacron fibers, cotton fibers, wool fibers, polymeric fibers or other soft fibrous material or soft compressible material, for example, that provides a soft, comfortable, and breathable barrier between the inflatable tube and the individual's head 7. The velour can be adhered to the tube via an adhesive, a solvent bond, a thermal bond, or other attachment method. The entire surface of each inflatable tube, both the contact surface 150 facing the individual's head 7, and the non-contact surface 155 facing the inflatable environment can be coated with a velour as shown in FIG. 2A. Alternately, the velour can be applied only to the contact surface 150 of each inflatable tube that is intended to be placed into contact with the head 7 of the individual as shown in a cut-away view of the inside contact surface 150 of the head covering 5 in FIG. 2B.

Figure 3A:
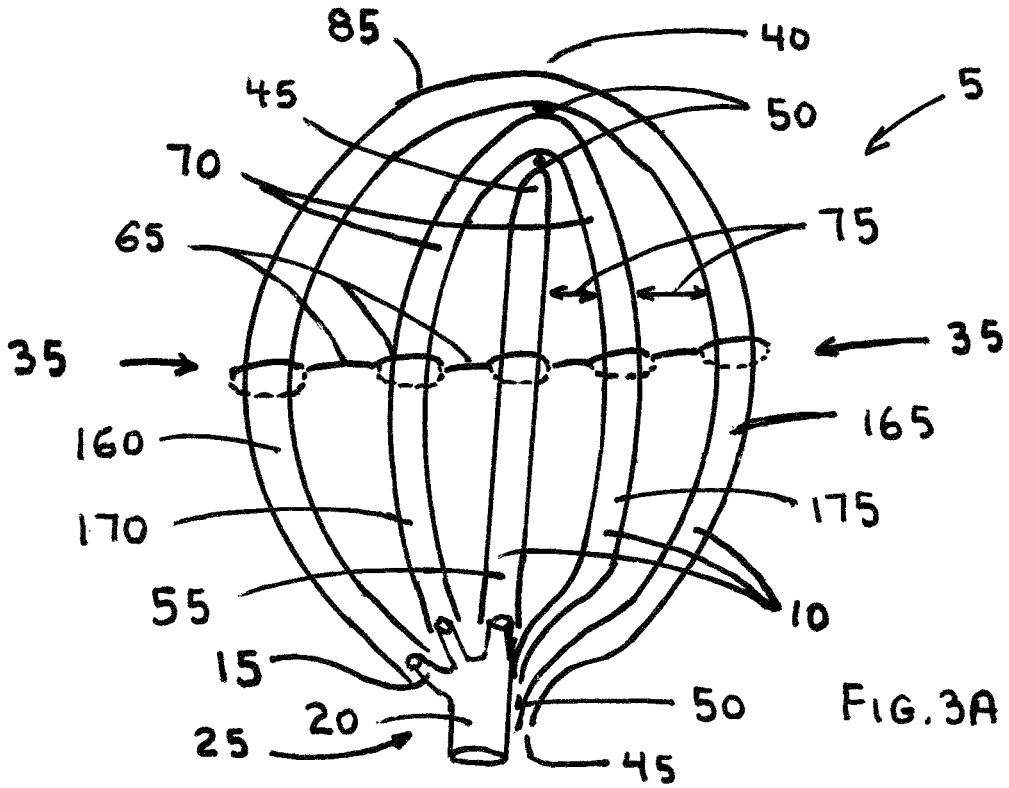
FIG. 3A is a top view of the head covering having three inflatable tubes, a lateral tube portion and a middle-side tube portion extend on the right and left sides of the head covering.
Figure 3C:
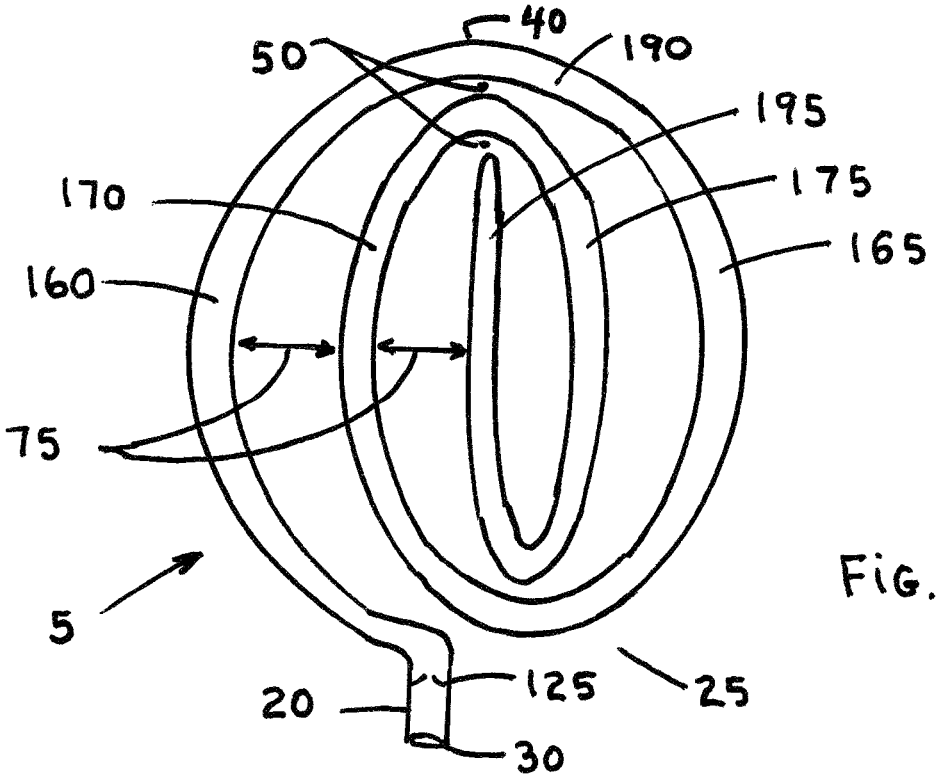
FIG. 3C is a top view of the head covering having a single inflatable tube that is wound in a spiral pattern around the front, back, and each side of the head covering and having tube attachments to hold the inflatable tubes in position.

FIGS. 3A-3D show other configurations for orienting the inflatable tubes 10 of the head covering 5 of the present invention. FIG. 3A shows a top view of the head covering 5 having three inflatable tubes 10, a top inflatable tube 55, a middle-side inflatable tube 70, and a lateral inflatable tube 85. The lateral inflatable tube 85 extends from a nipple 15 on the manifold across one side 35 of the head covering 5 (i.e., the left lateral tube portion 160), across the front 40 of the head covering 5, across the other side 35 of the head covering 5 (i.e., the right lateral tube portion 165), and extends with inflation fluid communication to the back 25 of the head covering 5 where it forms an end closure 45 that is bonded to the manifold or other structure of the head covering 5 forming a tube attachment 50. The middle-side inflatable tube 70 similarly extends from a nipple 15 on the manifold across one side 35 of the head covering 5 (i.e., the left middle-side tube portion 170), across the front 40 and extending along the other side 35 of the head covering 5 (i.e., the right middle-side tube portion 175), and further extends with inflation fluid communication to the back 25 of the head covering 5 where it forms an end closure 45 that is bonded to the manifold or to another portion of the head covering 5 near the back 25 of the head covering 5 forming a tube attachment. The top inflatable tube 55 extends from a nipple 15 on the manifold to an end closure 45 located at the front 40 of the head covering 5. The end closure 45 of the top inflatable tube 55 is attached via a tube attachment 50 to the middle-side inflatable tube 70 which is attached via a tube attachment 50 to lateral inflatable tube 85 located at the front 40 of the head covering 5 to hold the top inflatable tube 55, middle-side inflatable tube 70, and lateral inflatable tube 85 together at the front 40 of the head covering 5. Tube connectors 65 can be located along the inflatable tubes 10 between the front 40 and back 25 of the head covering 5 to provide a preferred tube spacing 75 as described earlier from the top inflatable tube 55 to the left middle-side tube portions 170, and tube connectors 65 are located between the left middle-side tube portions 170 and the left lateral tube portions 160, for example, as shown in FIG. 3A. The manifold can be located at the back 25 of the head covering 5 as shown in FIGS. 3A and 3C or alternately, the manifold can be located at the front 40 of the head covering 5 or other location on the head covering 5.

Figure 3D:
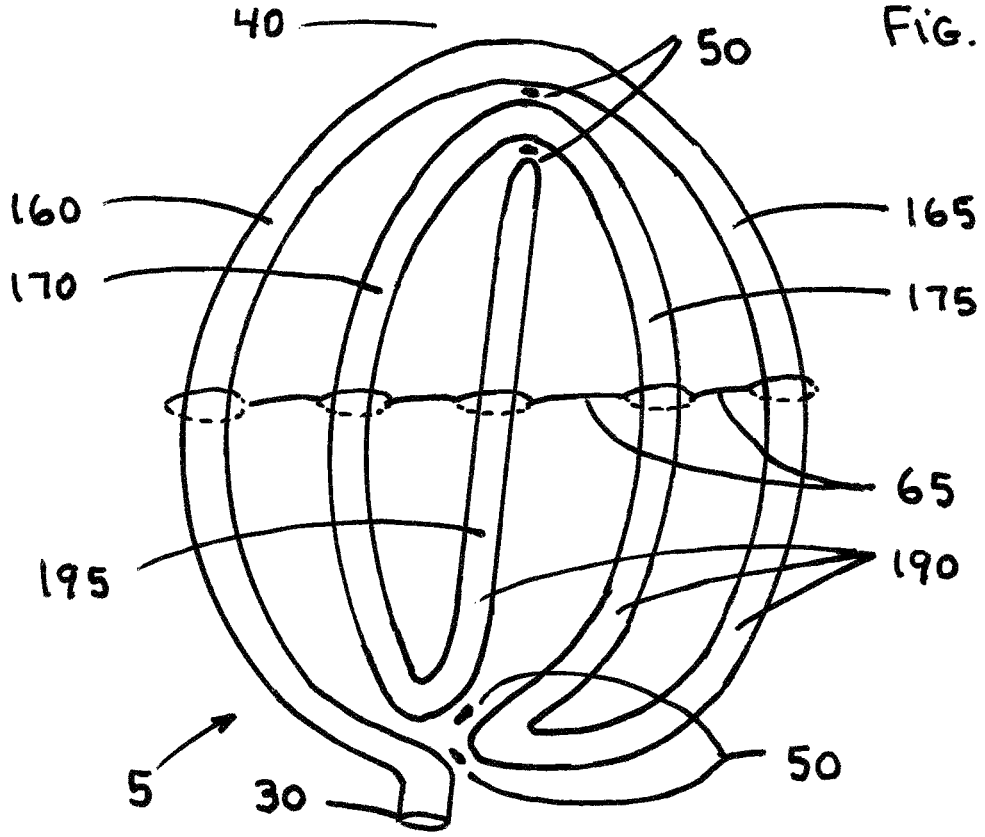
FIG. 3D is a top view of the head covering having a single inflatable tube that is wound in a curved pattern around the front, back, and each side of the head covering and having tube attachments to hold the inflatable tubes in position.
Figure 3B:
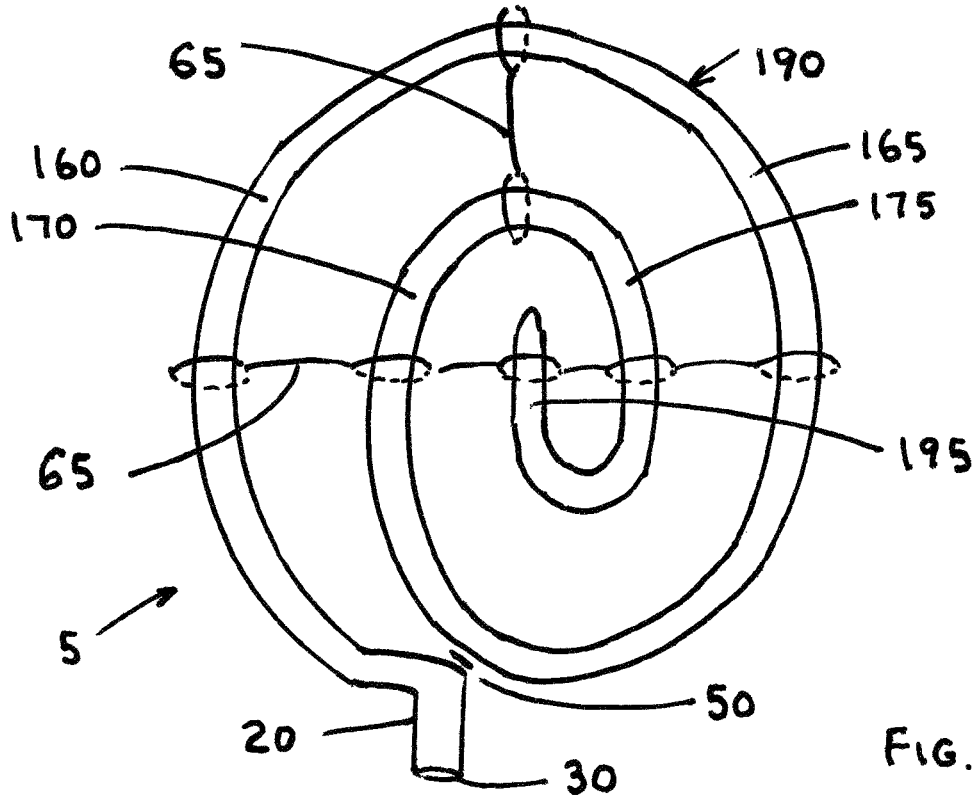
FIG. 3B is a top view of the head covering having a single inflatable tube that is wound in a spiral pattern around the front, back, and each side of the head covering.

FIGS. 3B and 3C show a single inflatable tube 190 that is wound in a pattern to form the head covering 5 of the present invention. FIGS. 3B and 3C show a top views of the single inflatable tube 190 that is wound in a spiral manner from the back 25 of the head covering 5 where the single inflatable tube 190 is attached to a manifold; the single inflatable tube 190 has a left lateral tube portion 160, a right lateral tube portion 165, a left middle-side tube portion 170, aright middle-side tube portion 175, and a top tube portion 195. The top tube portion 195, left and right middle-side tube portions 170 and 175, and left and right lateral tube portions 160 and 165 which are each portions of a single inflatable tube 190 can be joined via tube connectors 65 in the front 40 of the head covering 5 as shown in FIG. 3B or the inflatable tube portions can form a tube attachment 50 to neighboring inflatable tubes 10 or other elements of the head covering 5 at a location at the front 40 of the head covering 5 as shown in FIG. 3C or at other locations on the head covering. The inflatable tube configuration of FIGS. 3B and 3C provide for direct air flow from the front 40 of the head covering 5, across the head 7, and toward the back 25 of the head covering 5 to the individuals head 7 between each of the inflatable tubes 10 through the tube spacings 75.

FIG. 3D shows a single inflatable tube 190 wound in a curved pattern with a right middle-side tube portion 175, a left middle-side tube portion 170, a right lateral tube portion 165, and a left lateral tube portion 160. Such curved pattern for single inflatable tube 190 can have a back and forth configuration, a folded zig zag configuration or other configuration and still remain within the scope and teachings of the present invention.

Figure 4A:
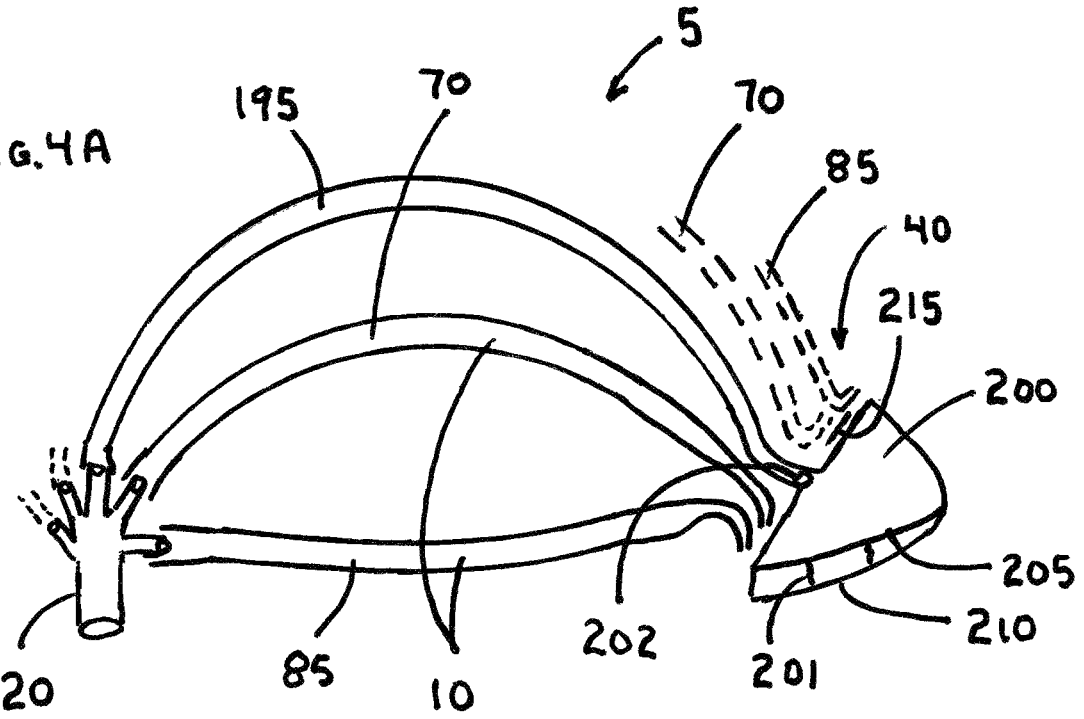
FIG. 4A is a perspective view of the head covering having a brim that is inflated by one of the inflatable tubes.
Figure 4B:
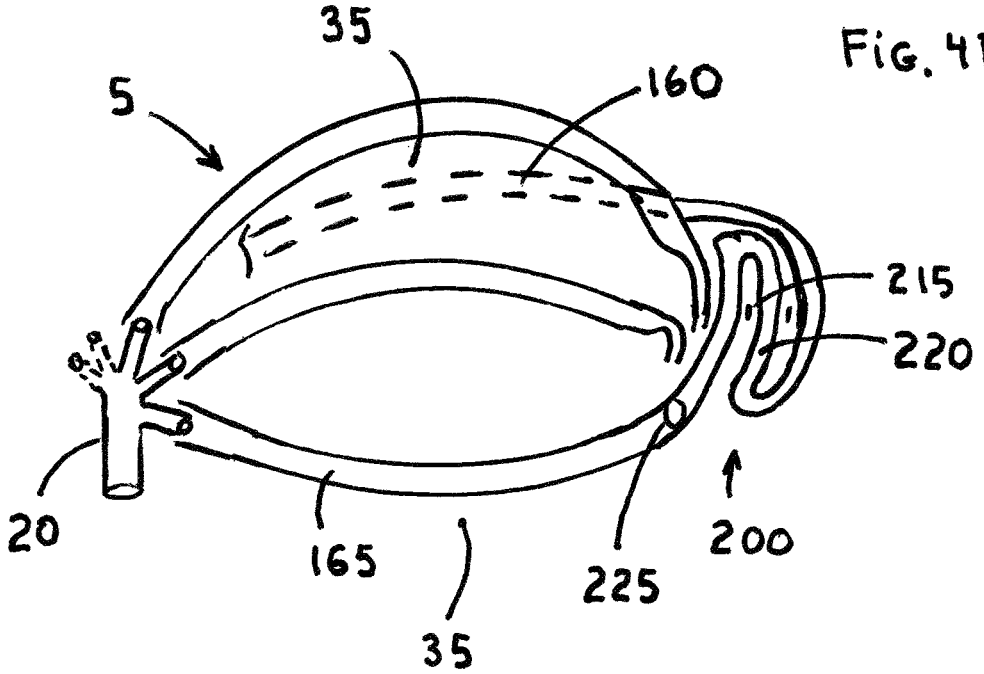
FIG. 4B is a perspective view of the head covering having a brim that is formed in part by one or more of the inflatable tubes.

FIGS. 4A-4B shown a brim 200 formed from inflatable elements attached to the head covering 5 of the present invention. The brim 200 is intended to prevent sun or rain from maintaining contact with the face of the individual. FIG. 4A shows a perspective view of one embodiment of an inflatable brim 200 attached to the head covering 5. The brim 200 is formed from a thin plastic film or sheet (range 0.002-0.008 inch thickness) that has had thermal welds 201 formed to hold the upper polymer sheet 205 to a lower polymer sheet 210 and shaped to form a thin brim 200 for the head covering 5. The brim 200 is attached via a brim attachment 215 to the head covering 5 using thermal bonding, solvent bonding, or adhesive bond to one or more of the inflatable tubes 10 of the head covering 5 near the front 40 such that inflation of the head covering 5 also inflates the brim 200. As shown in FIG. 4A, the top tube portion 195, for example, of the inflatable tube 10 is connected to the brim air inlet 202 near the front 40 of the head covering 5. FIG. 4B shows the brim 200 being formed from a tube extension 220 of one of the inflatable tubes 10 or tube portions of the head covering 5. As shown in FIG. 4B the right lateral tube portion 165 on one side 35, for example, forms a junction 225 with the brim 200; the geometric winding pattern, such as a zig zag pattern, for example, of the tube extension 220 becomes the brim 200. The tube extension 220 can extend further beyond the brim attachment 215 and be in fluid communication with the left lateral tube portion 160, for example, on the other side 35 of the head covering 5. Other configuration of the brim 200 are contemplated that are inflated along with one or more inflatable tubes 10 of the head covering 5. Individual tube extensions 220 (or portions of such tube extensions) can be held together into contact with each other using an adhesive, thermal bonding, or other bonding methods.

FIGS. 5A and 5B show an anti-kink tubing 230 that can be used with the head covering 5 of the present invention to prevent kinking of the inflatable tube 10 at a tight bend 235 and thereby allowing continuous flow of inflation fluid across a tight bend 235 that can occur in one or more of the inflatable tubes 10 of the head covering 5 or brim 200. As shown in FIG. 5A a small polymeric or porous polymeric flexible anti-kink tubing 230 with an inner diameter 232 of 0.010 inch (range 0.005-0.030 inch) can be placed within one or more of the inflatable tubes 10 of the head covering 5 either throughout the length of the inflatable tube 10 or in the region of potential kinking (having anti-kink tubing length 233 about 2 cm, range 0.5-8 cm) of the inflatable tube 10. The porous anti-kink tubing 230 provides inflation fluid such as air from a region upstream of a kink or tight bend 235 in the inflatable tubing 10, through the anti-kink tubing wall 237 or anti-kink tubing lumen 239, across the tight bend 235 or kink in the inflatable tube 10, and out of the porous anti-kink tubing wall 237 or anti-kink tubing lumen 239 into the inflatable tube lumen 238 downstream 245 of a tight bend 235 during inflation. The anti-kink tubing 230 can be formed from a porous or fibrous material such as expanded polytetrafluoroethylene (ePTFE), spun fibrous polyurethane, fibrous silicone, or other porous or fibrous plastic material; a thermoplastic such a PET, Nylon, polyethylene, and others, for example, can also be used to for the anti-kink tubing 230. The porous anti-kink tubing 230 can alternately be a porous or fibrous solid cylinder with a round, oval, or flattened cross-section. The solid cylinder can allow passage of air through the porous anti-kink tubing wall 237; once a kink has been resolved or opened by applying inflation pressure to the inflatable tubes 10, the need for the anti-kink tubing 230 is reduced or eliminated and the head covering 5 can be fully inflated to its inflated configuration for placement onto the head 7 of the individual.

Figure 6:
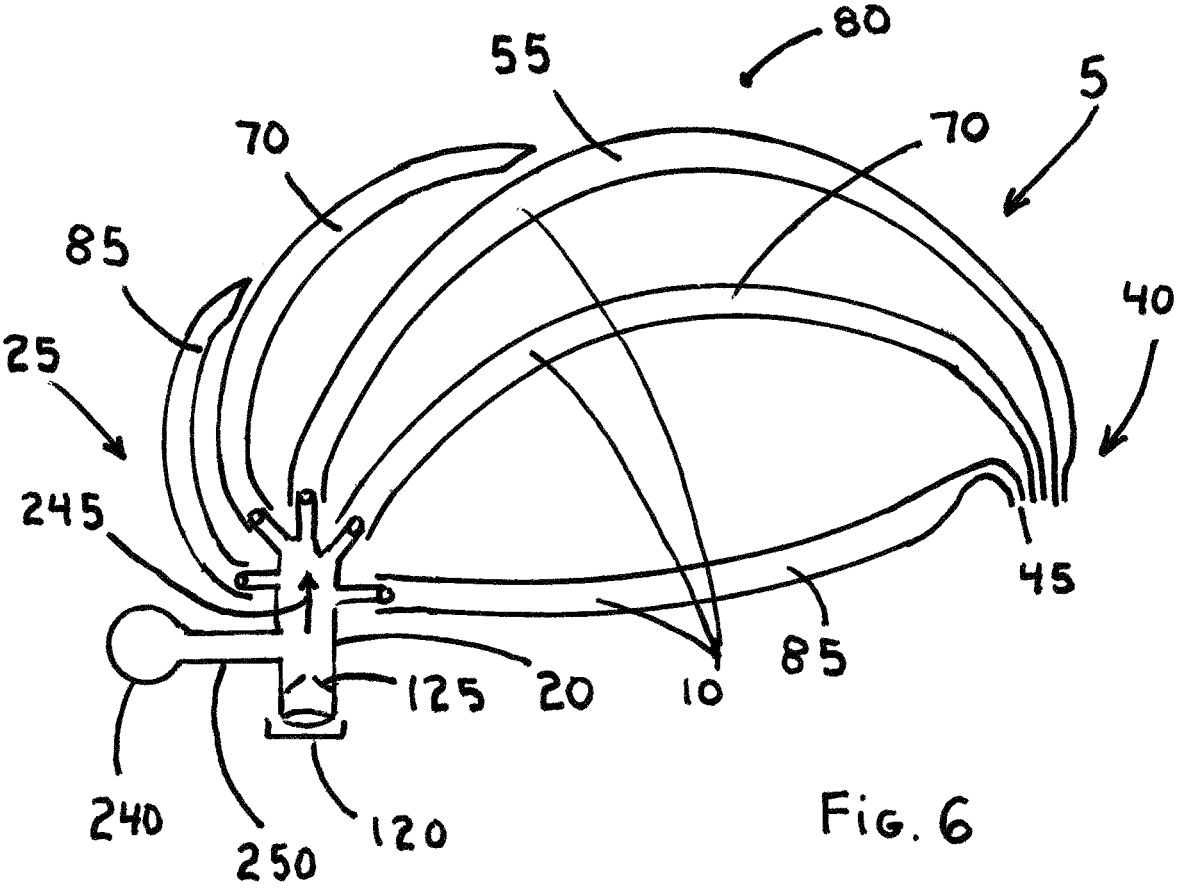
FIG. 6 is a perspective view of a head covering having an expansion bladder attached to the manifold.

The head covering 5 of the present invention can have an expansion bladder 240 located in fluid communication with the one or more inflatable tubes 10 (or tube portions of a single inflatable tube 190, for example); the expansion bladder 240 can be directly attached to the manifold downstream 245 of the valve 125 or inflation port blocker 120; i.e., between the inflatable tubes 10 and the inflation port blocker 120 as seen in FIG. 6, for example. The expansion bladder 240 is of particular benefit to maintain inflation pressure within inflatable tubes 10 formed from materials such as PET or other non-elastic polymer, for example, that may not be appreciably elastic in character. The expansion bladder 240 can be spherical in shape, cylindrical in shape, or have another shape that provides for elastic stretching of the expansion bladder 240 as the inflation pressure is increased within the inflatable tubes 10. The expansion bladder 240 is an elastomeric chamber that has a volume that is small (about 10%, range 2-20%) in comparison to the volume of sum of the internal inflated volume of all of the inflatable tubes 10 or tube portions. The expansion bladder 240 is inflated along with the inflatable tubes 10 but inflates in volume due to the elasticity of the material that forms the expansion bladder 240. The expansion bladder 240 can provide inflation medium such as the air that was used to inflate the inflatable tubes 10 and bladder back into inflatable tubes that are formed from a material that is less elastic than the expansion bladder 240. Thus as the inflatable tubes 10 undergo a small amount of creep over time, the expansion bladder 240 will contract slightly and provide small amounts of inflation medium back into the inflatable tubes 10 to ensure that the inflatable tubes 10 are maintained at a reasonable working pressure about the same as the inflated pressure of the head covering 5 of about 35 cm H2O, range 20-90 cm H2O.

The expansion bladder 240 can be connected in fluid communication with the inflatable tubes 10 via a small diameter resistance tubing 250 of internal diameter of 0.010 inches (range 0.002-0.025 inches) and having a length of 1 cm (range 0.2-2.0 cm); the resistance tubing 250 ensures that an external environmental compression force 90 on the outside of the inflatable tubing does not allow the inflatable tubes 10 to become significantly compressed or rapidly flattened at the site of the external compression force due to a fluid pathway out of the inflatable tubing and into the expansion bladder 240; such compression of the inflatable tube 10 by an external environmental surface can cause contact of an outside environmental surface with the individual's head 7 without the benefit provided by the fluid-filled inflatable tubes 10 located between the head 7 of the individual and the external environmental surface.

The expansion bladder 240 is formed from an elastic material such as silicone, polyurethane, or other elastomeric polymer or composite. A braiding of the expansion bladder 240 can be utilized to ensure that the expansion bladder 240 can only attain a specified maximum volume to ensure that the inflatable tubes 10 are not able to become compressed or flattened at the site of an external compressive force 90.

The inflatable tubes 10 and tube portions of the present invention are inflated via expiratory pressure of the individual. The inflatable tubes 10 are able to be inflated in approximately 15 seconds (range 10-60 seconds) using a expiratory pressure of 35 cm H2O, range 20-90 cm H2O. The internal inflated volume of the tubes of the head covering 5 is about 750 cubic cm (range 300-1500 cubic cm). The expansion bladder 240 has an inflated volume at operating pressures of about 20 cubic cm (range 5-100 cubic cm) and is able to reduce in volume by 10% while maintaining a pressure reduction of less than 5% within the expandable bladder and the inflatable tubes 10 due to the elastic forces provided by the material of construction for the elastic expansion bladder 240 during expansion of the expansion bladder 240.

Common reference numeral used throughout the specification and drawings for various embodiments describe structural elements that have the same description. Structural elements found in one embodiment can be applied to other embodiments and understood to be included within the present invention. Any of the embodiments presented can contain any of the features found in any other of the embodiments found in the present specification.

The invention claimed is:

1. A head covering configured to provide a partial barrier between a head of an individual and the outside environment, said head covering comprising, A. one or more inflatable tubes extending along a front, back, and two sides of said head covering, B. said one or more inflatable tubes being connected and in fluid communication with a manifold having an inflation port for inflating said inflatable tubes, said manifold having an inflation port blocker configured to prevent leakage of inflation fluid out of said one or more inflatable tubes through said inflation port, C. said one or more inflatable tubes being formed from a flexible polymer such that said inflatable tubes can be folded to a flat configuration for transportation in an uninflated configuration, D. said head covering being configured to be inflated to an inflated configuration via direct exhalation by the individual into said inflation port, E. said head covering further comprising an expansion bladder, said expansion bladder being formed from an elastomeric material, said expansion bladder being placed in fluid communication with said one or more inflatable tubes between said one or more inflatable tubes and said inflation port blocker, F. a resistance tube being placed between said expansion bladder and said one or more inflatable tubes, said resistance tubing configured to reduce air flow from said one or more inflatable tubes upon contact of said one or more inflatable tubes with an external environmental force.

2. The head covering of claim 1 wherein said one or more inflatable tubes comprises a only one single inflatable tube that is configured to be wound around said back, front, and two sides of said head covering.

3. The head covering of claim 2 wherein a first portion of said single inflatable tube is connected to a second portion of said single inflatable tube via a connector, said connector providing specified spacing between said first portion and said second portion of said single inflatable tube.

4. The head covering of claim 3 wherein said first portion is separated by a tubing spacing from said second portion, said tube spacing configured to allow environmental air to make direct contact with the head of the individual.

5. The head covering of claim 1 wherein said one or more inflatable tubes comprises separate inflatable tubes, said separate inflatable tubes comprising a right side inflatable tube residing on a right side of said head covering and a left side inflatable tube residing on a left side of said head covering, each of said individual inflatable tubes being connected separately to said manifold.

6. The head covering of claim 5 wherein said one or more inflatable tubes further comprises a top inflatable tube configured to extend along a top of said head covering.

7. The head covering of claim 5 wherein said one or more inflatable tubes are formed from a noncompliant polymer such that said one or more inflatable tubes do not stretch upon contact with an external environmental force.

8. The head covering of claim 1 wherein said one or more inflatable tubes are formed from a polymer such that a head covering diameter of said head covering is increased by increasing an inflation pressure provided to said one or more inflatable tubes.

9. The head covering of claim 1 wherein said one or more inflatable tubes are one or more braided inflatable tubes such that a head covering diameter of said head covering is decreased by increasing an inflation pressure provided to said one or more inflatable tubes.

10. The head covering of claim 1 wherein said one or more inflatable tubes have an inflatable tube diameter that ranges from 0.3 inches to 1.5 inches.

11. The head covering of claim 1 further comprising an anti-kink tubing placed within a tight bend in an inflatable tube lumen of said one or more inflatable tubes, said anti-kink tubing formed from a thermoplastic that resists kinking around a radius of curvature of less than 0.15 inches and provide passage for said inflation fluid across said tight bend.

12. The head covering of claim 1 further comprising a brim, said brim being in fluid communication with said one or more inflatable tubes, said brim extending forward from a front of said head covering, said brim being configured to block sun or rain from a face of the individual.

13. The head covering of claim 1 wherein a first inflatable tube of said one or more inflatable tubes is connected to a second inflatable tube of said one or more inflatable tubes via a connector, said connector providing a specified tube spacing between said first and said second of said one or more inflatable tubes.

14. The head covering of claim 13 wherein said first inflatable tube is separated by a tubing spacing from said second inflatable tube, said tube spacing configured to allow environmental air to make direct contact with the head of the individual.

15. The head covering of claim 1 wherein said one or more inflatable tubes are coated with a velour material, said velour material being configured to provide a soft contact surface of the head covering with the head of the individual.

16. The head covering of claim 1 wherein said head covering is configured in said uninflated configuration to be folded to form a volume less than 15 cubic inches and fit within a standard shirt or standard pant pocket.

17. The head covering of claim 1 wherein said head covering is configured to reduce an external environmental force from transferring through said one or more inflatable tubes in an inflated configuration to the head of the individual.

18. An inflatable head covering configured to provide a partial barrier between a head of an individual and an outside environmental force, said head covering comprising, A. one or more inflatable tubes extending along a front, back, right and left sides of said inflatable head covering, B. said one or more inflatable tubes being connected to a manifold having an inflation port for inflating and deflating said inflatable head covering, C. said one or more inflatable tubes being formed from a flexible polymer such that said inflatable tubes can be folded to a flat configuration for storage in a shirt or pant pocket, D. a first portion of one single inflatable tube of said one or more inflatable tubes being connected to a second portion of said one single inflatable tube via a connector, said connector providing specified spacing between said first portion and said second portion, E. wherein said first portion is separated by a tubing spacing from said second portion, said tube spacing configured to allow environmental air to make direct contact with the head of the individual.

19. A head covering configured to provide a partial barrier between a head of an individual and the outside environment, said head covering comprising, A. one or more inflatable tubes extending along a front, back, and two sides of said head covering, B. said one or more inflatable tubes being connected and in fluid communication with an inflation port for inflating said inflatable tubes, said head covering having an inflation port blocker configured to prevent leakage of inflation fluid out of said one or more inflatable tubes through said inflation port, C. said one or more inflatable tubes being formed from a flexible polymer such that said inflatable tubes can be folded to a flat configuration for transportation in an uninflated configuration, D. wherein said one or more inflatable tubes are one or more braided inflatable tubes such that a head covering diameter of said head covering is decreased by increasing an inflation pressure provided to said one or more inflatable tubes.

* * * * *